US006552313B2

(12) United States Patent
Takashige et al.

(10) Patent No.: US 6,552,313 B2
(45) Date of Patent: Apr. 22, 2003

(54) HIGH-FREQUENCY HEATING APPARATUS FOR MAXIMIZING INPUT CURRENT WHILE SECURING A UNIFORM MARGIN RELATIVE TO THE CUTOFF CURRENT

(75) Inventors: Yutaka Takashige, Kishiwada (JP); Shinichi Masuda, Tondabayashi (JP); Koji Ueda, Mino (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/075,315

(22) Filed: Feb. 15, 2002

(65) Prior Publication Data

US 2002/0121515 A1 Sep. 5, 2002

Related U.S. Application Data

(63) Continuation-in-part of application No. PCT/JP01/05073, filed on Jun. 14, 2001.

(30) Foreign Application Priority Data

Jun. 16, 2000 (JP) ..... 2000-181494

(51) Int. Cl.[7] ..... H05B 6/68

(52) U.S. Cl. ..... 219/716; 219/702; 219/723

(58) Field of Search ..... 219/702, 704, 219/705, 710, 715, 716, 721, 722, 723

(56) References Cited

U.S. PATENT DOCUMENTS 4,810,847 A * 3/1989 Ito ..... 219/626
4,992,637 A * 2/1991 Ishiyama ..... 219/716
5,124,518 A * 6/1992 Lee ..... 219/718
5,208,432 A * 5/1993 Han ..... 219/716

FOREIGN PATENT DOCUMENTS

| | | |
|---|---|---|
| JP | 11-087047 | 3/1999 |
| JP | 11-283737 | 10/1999 |
| JP | 2000-323271 | 11/2000 |

* cited by examiner

*Primary Examiner*—Philip H. Leung
(74) *Attorney, Agent, or Firm*—Birch, Stewart, Kolasch & Birch, LLP

(57) ABSTRACT

A high-frequency heating apparatus is designed to maximize the input current while securing a uniform margin relative to the cutoff current, thereby enabling maximized and efficient output of high-frequency waves. The high-frequency heating apparatus includes: a power supply unit; an input current detector; a power converting unit for converting the power from the power supply unit into high-frequency waves; an inverter controller for controlling a semiconductor device; a magnetron for radiating electromagnetic waves; and a circuit for implementing negative feedback control, in the inverter control circuit, of the output from the input current detector. The apparatus further includes a control circuit having a microcomputer for outputting signals to the inverter controller so as to control the input current such that the input current characteristic of the high-frequency heating apparatus will approximate the current cutoff characteristic of the overcurrent circuit breaker with respect to the elapsed time.

4 Claims, 10 Drawing Sheets

Signal Conversion by Control Circuit 20

Waveform 4

Waveform 5

Waveform 6

HIGH-FREQUENCY HEATING APPARATUS FOR MAXIMIZING INPUT CURRENT WHILE SECURING A UNIFORM MARGIN RELATIVE TO THE CUTOFF CURRENT

This application is a Continuation-In-Part of copending PCT International Application No. PCT/JP01/05073 filed on Jun. 14, 2001, which was not published in English and which designated the United States and on which priority is claimed under 35 U.S.C. §120, the entire contents of which are hereby incorporated by reference.

TECHNICAL FIELD

The present invention relates to a high-frequency heating apparatus using as the power unit a semiconductor power converter for generating high-frequency power.

BACKGROUND ART

Conventional circuit configurations of high-frequency heating apparatus are shown in FIG. 7 and FIG. 9 while their respective current control schemes are described in FIG. 8 and FIG. 10.

That is, there are roughly two classes of input current control schemes: the first scheme is achieved by the configuration shown in FIG. 7, where current control is made based on the primary-side current, following the control characteristics shown in FIGS. 8(*a*) and (*b*) (see Japanese Patent Application Laid-Open Hei 11 No. 283737); and the second scheme is achieved by the configuration shown in FIG. 9, where current control is made based on the secondary-side current (magnetron current), following the control characteristic shown in FIG. 10. These will be explained in this order.

First, FIG. 7 shows a circuit configuration of a high-frequency heating apparatus using a conventional semiconductor power converter.

In the circuit configuration, a power unit 1 is configured so that the input from a commercial power supply 4(with an overcurrent circuit breaker 4*a* disposed in the power line) is rectified through a rectifier 5 and the output is smoothed by the combination of a coil 6 and a capacitor 7. A power converter 2 is comprised of a frequency changing circuit made up of a semiconductor device 9, diode 8, step-up transformer 11 and capacitor 12 for the electric power supply from power unit 1 and a high-voltage rectifying circuit made up of step-up transformer 11, a capacitor 14 and diode 13. The voltage which is obtained by high-voltage rectification through this rectifying circuit is converted into a high frequency by a magnetron 15 so as to output and emit microwaves over the food to be cooked. The circuit further includes an inverter controller 10 for ON-OFF control of semiconductor 9.

In the above configuration, in order to implement input current control, the voltage output from an input current detector 16 and input to inverter controller 10 is compared to the current control signal output from a control circuit 20 that governs the high-frequency heating apparatus as a whole, so as to determine the input current to the high-frequency heating apparatus. Inverter controller 10 also provides a protecting function for semiconductor device 9 and will stop the operation or take an appropriate action when an anomaly has occurred to stabilize the operation of semiconductor device 9.

Control circuit 20 as the circuit system for input current control is usually connected to a potential (on the secondary side), insulated from the primary side, and hence outputs a signal via a photocoupler 21.

Now, the input current control system for the conventional high-frequency heating apparatus will be described.

In the high-frequency heating apparatus based on the conventional primary-side input current control, the output signal from control circuit 20 and the output from input current detector 16 are compared, so that the input current will be kept constant with respect to the elapsed time of heating as shown in FIG. 8(*a*) or so that the 'short-time high power' control signal for setting the output at the maximum during only the initial period Tmax (about 1 min. 30 sec. to 3 min.) from the start of heating and reducing it to a lower level after that as shown in FIG. 8(*b*) will be output.

As a high-frequency heating apparatus based on secondary-side current control, a circuit configuration as shown in FIG. 9 is present, which includes a magnetron drive circuit configuration equivalent to the high-frequency heating apparatus shown in FIG. 7. Hence like components are allotted with like reference numerals without description.

The configuration in FIG. 9 differs from the configuration shown in FIG. 7 in that the detecting position of an input current detector 16A is moved from the primary side to the secondary side (the magnetron current side) so as to perform control based on the secondary-side current. This secondary-side current control will regulate the magnetron current so as to be constant, whereby the input current is controlled presenting the operating characteristic indicated at 8A in FIG. 10.

However, if such a conventional input current control as shown in FIG. 8(*a*) is implemented, there occur cases where the input current will not lower even when the temperature has been elevated since the input current is controlled to be constant, so that the high-frequency heating apparatus is forced to operate at high temperatures. In the case of the short-time high power configuration shown in FIG. 8(*b*), the high power only lasts about 1 min. 30 sec. to 3 min. Therefore, this configuration is in its way effective in heating for a short period with light loads (such as heating cooked rice, etc.) because of the shortness of cooking time. However, heating up frozen foods or the like needs a heating time of about 4 min. to 8 min., hence, on the contrary, the cooking will take up a longer time because the heating power is lowered when the short-time high power operation is switched into the normal operation. This is the drawback of this configuration. Accordingly, this configuration is not able to make the best use of the input power of the high-frequency heating apparatus, so results in the problem that high-frequency output cannot be used effectively to the maximum.

Most of the magnetron drive circuits for high-frequency heating apparatus currently put on the market use a commercial a.c. power supply transformer, which has the characteristic shown in FIG. 6(*a*), in that the input current declines with the passage of time from the start of heating. This characteristic is adapted to have the appearance similar to the current cutoff characteristic of a typical current breaker for home use, with a constant margin secured relative to the cutoff current.

The conventional, primary-side current control systems (indicating the so-called switching systems using a semiconductor device, herein), however, are adapted to have the characteristics shown in FIGS. 8(*a*) and 8(*b*), having inconstant margins relative to the cutoff current of the current breaker. Hence there has been a possibility that the current breaker might operate at times when some other appliance is activated.

Further, since the switching system differs from the commercial a.c. power supply transformer system in input current control characteristic or high-frequency output characteristic over the elapsed time of heating, there is no correlation as to cooking time in the operations of auto-cooking menu between the two systems. Therefore, if system change from the high-frequency heating apparatus of the commercial power supply transformer system to that of the switching system is attempted, cooking methods should be once again studied. This makes system change difficult.

Next, the problem with the use of the current control scheme based on the secondary side current (magnetron current) will be mentioned. In this case, the current through the magnetron is controlled so as to be constant, which means that the power consumption of the magnetron should be controlled to be constant because the following relation holds:

(Magnetron Current)×(Magnetron Voltage)=(Magnetron Power Consumption).

Here, if it is assumed, for example, that the power supply voltage to the high-frequency heating apparatus drops by 10%, the input current increases by 10% because the apparatus is controlled so that the power consumption will be kept constant, presenting the current control operation shown at 8B in FIG. 10.

This will induce temperature rise in the parts of the high-frequency heating apparatus because the power consumption is kept constant, despite the fact that the cooling capability of the cooling fan in the high-frequency heating apparatus is lowered due to the voltage drop.

Increase in the input current upon voltage drop means an approach to the cutoff current of the current breaker and may cause cutout in the current breaker in the worst case, which may affect the other devices if they are supplied from the outlets connected to the same breaker.

The present invention has been devised in order to solve the above problem, it is therefore an object of the present invention to provide a high-frequency heating apparatus which can use the maximum input current while securing a uniform margin relative to the cutoff current of the overcurrent circuit breaker, thereby enabling maximized and efficient output of high-frequency waves.

DISCLOSURE OF INVENTION

The present invention has been devised in order to solve the problems of the above conventional configurations, and is constructed as follows According to the present invention, a high-frequency heating apparatus comprises: a power supply unit, connected to a power supply line with an overcurrent circuit breaker arranged on the upstream side, supplied with a.c. power from the power supply line, and converting the a.c. power to a d.c. power; an input current detector; a power converting unit having at least one semiconductor device to convert the power from the power supply unit into high-frequency waves; a device controller for controlling the semiconductor device; an electromagnetic wave radiating unit for radiating electromagnetic waves using the power from the power converting unit; and a circuit for implementing negative feedback control, in the device controller, of the output from the input current detector. The high-frequency heating apparatus further includes an input current controller for controlling the input current such that the input current characteristic of the high-frequency heating apparatus will approximate the current cutoff characteristic of the overcurrent circuit breaker with respect to the elapsed time.

In the present invention, it is preferred that the high-frequency heating apparatus uses a commercial a.c. power supply high-voltage transformer in a magnetron drive circuit, and the input current controller controls the input current so that it will approximate the decreasing current characteristic with the passage of the heating time and the increasing current characteristic with the passage of the inactive time.

In the present invention, it is preferred that control of the input current is implemented taking into account the cases of reactivation.

In the present invention, it is preferred that the high-frequency heating apparatus incorporates electric devices such as a turntable motor, motor fan and the like that support the normal performance thereof, and the input current detector is to detect the input current including that for the accompanying electric devices and the input current detector controls the whole high-frequency heating apparatus based on the detected current. electromagnetic waves using the power from the power converting unit; and a circuit for implementing negative feedback control, in the device controller, of the output from the input current detector.

By the above configurations, the high-frequency heating apparatus of the present invention provides the following functions.

Analogical adaptation of the input current characteristic of the high-frequency heating apparatus to the characteristic of an overcurrent circuit breaker, for example, the overcurrent circuit breaker (breaker) for domestic use, makes it possible to secure a constant cutoff current and utilize the input current of the high-frequency heating apparatus at maximum. This configuration enables maximized and efficient output of high-frequency waves.

Further, since control of the input current is adapted so as to approximate the decreasing current characteristic with respect to the heating time and the increasing current characteristic with respect to the elapsed time of the inactive time in the high-frequency heating apparatus using a magnetron drive circuit and commercial a.c. power supply transformer, when auto-cooking menu operation needs to be transferred from the commercial a.c. power supply transformer system to the switching system in high-frequency heating apparatus design, this transfer can be simplified and can be done efficiently because of the use of the approximate characteristics.

Further, the power consumption and the cooling capacity of the cooling fan with respect to the power supply voltage can be correlated to each other by comparing this current control with the primary side current reference. Therefore, this scheme also contributes to an ideal cooling system in a high-frequency heating apparatus.

Moreover, when the frequency heating apparatus incorporates electric devices that support the normal performance of the high-frequency heating apparatus, such as a turntable motor, motor fan and the like, the input current of the high-frequency heating apparatus as a whole is detected, whereby, it is possible to provide a high-frequency heating apparatus with high precision.

BEST MODE FOR CARRYING OUT THE INVENTION

The embodiment of the present invention will be described with reference to the drawings.

Figure 1:
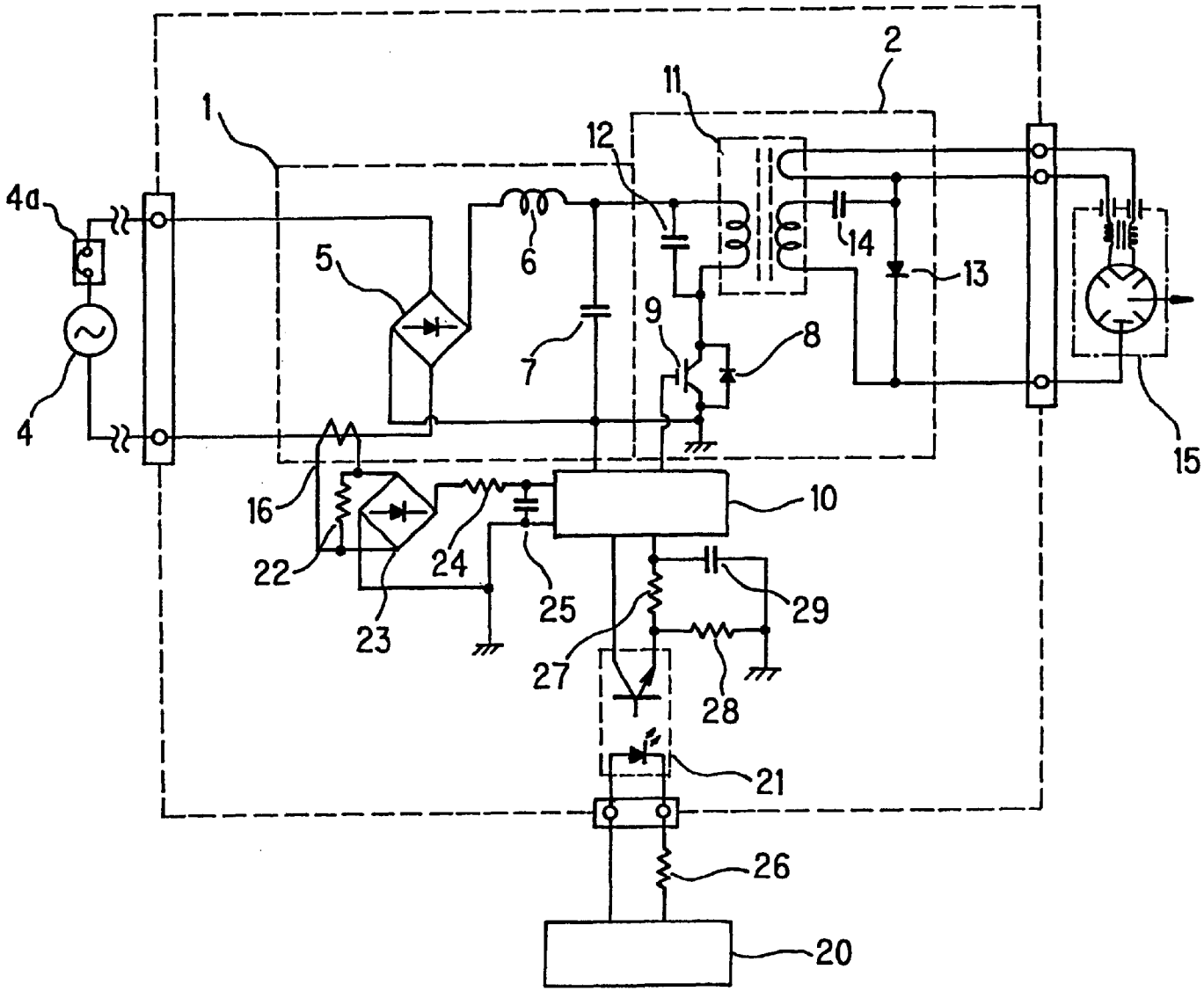
FIG. 1 is a circuit diagram showing a high-frequency heating apparatus according to the embodiment.
Figure 2:
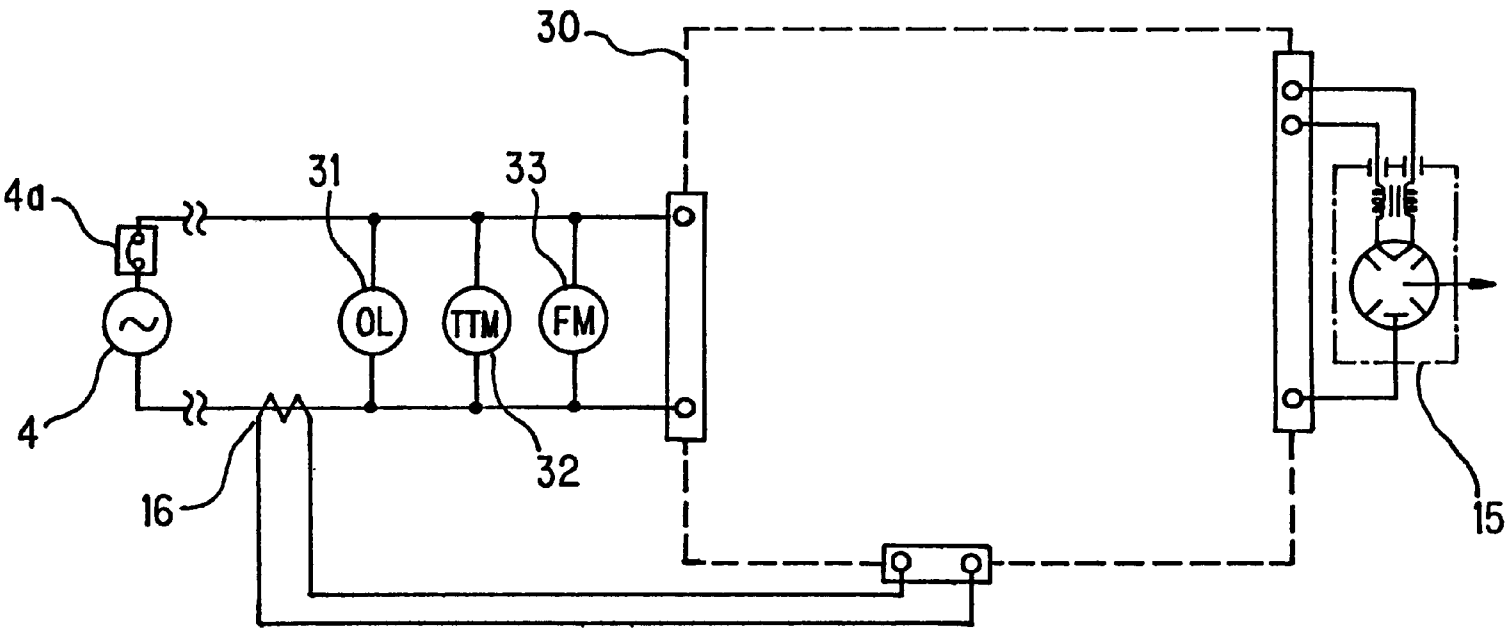
FIG. 2 is a circuit diagram showing a high-frequency heating apparatus including functional devices.
Figure 3:
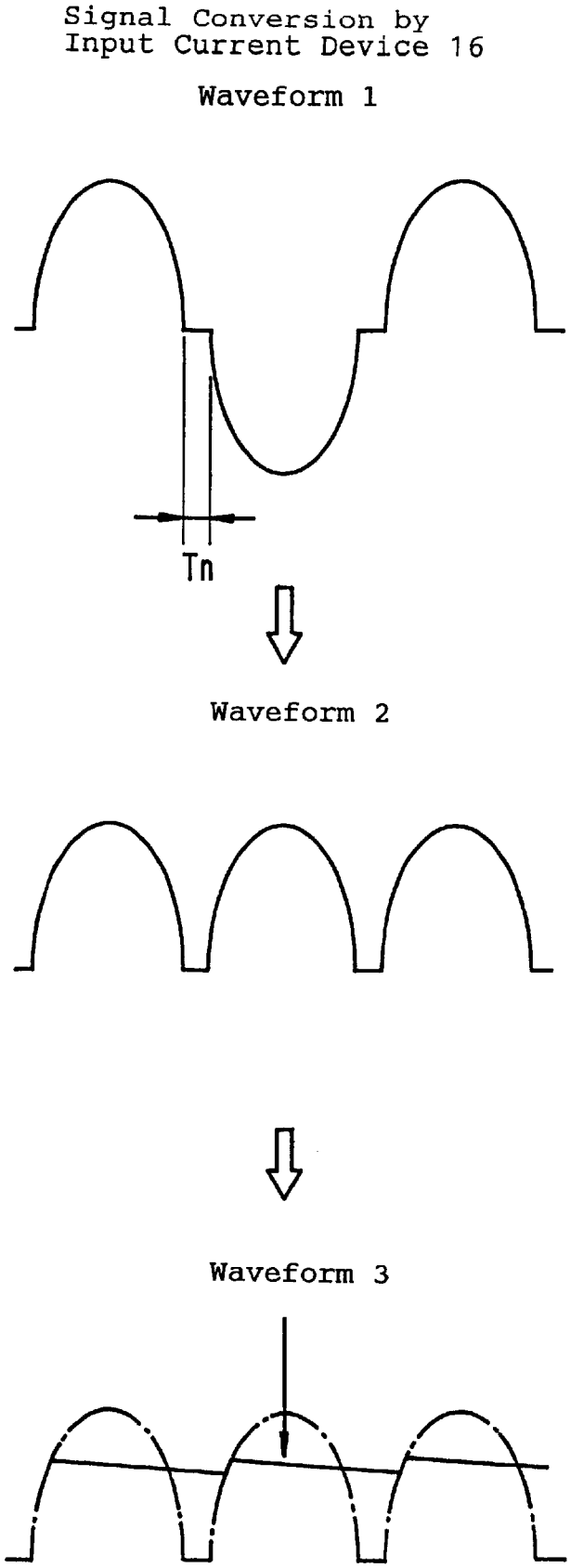
FIG. 3 is a diagram showing output waveforms from a current detector for explaining the comparison between input currents.
Figure 4:
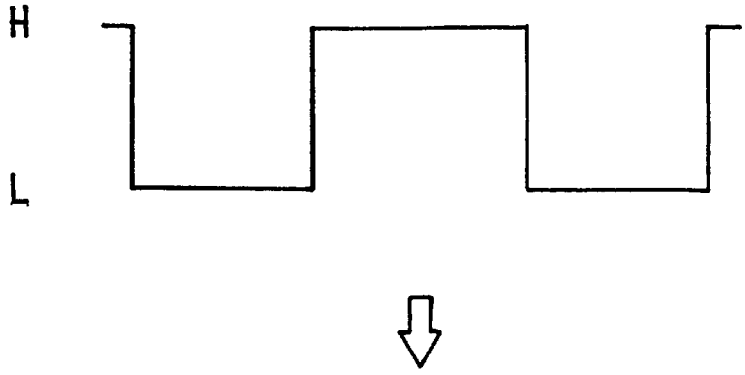
FIG. 4 is a diagram showing output waveforms from a controller in a similar manner.
Figure 4:
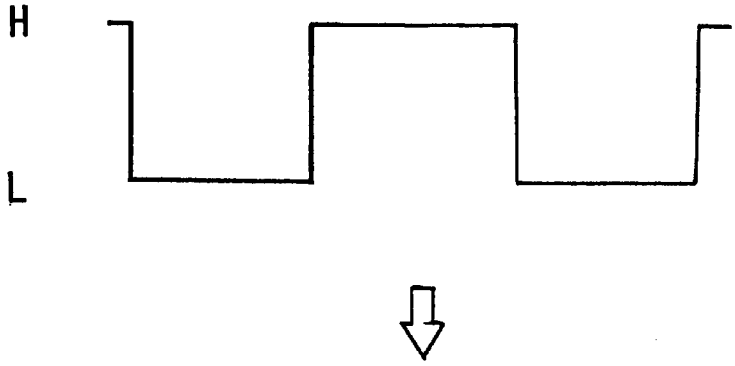
Figure 4:
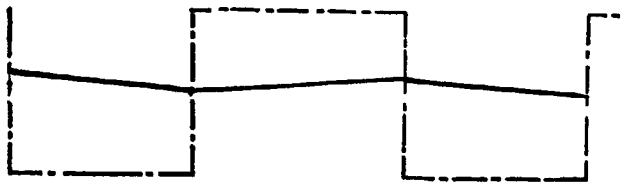
Figure 5:
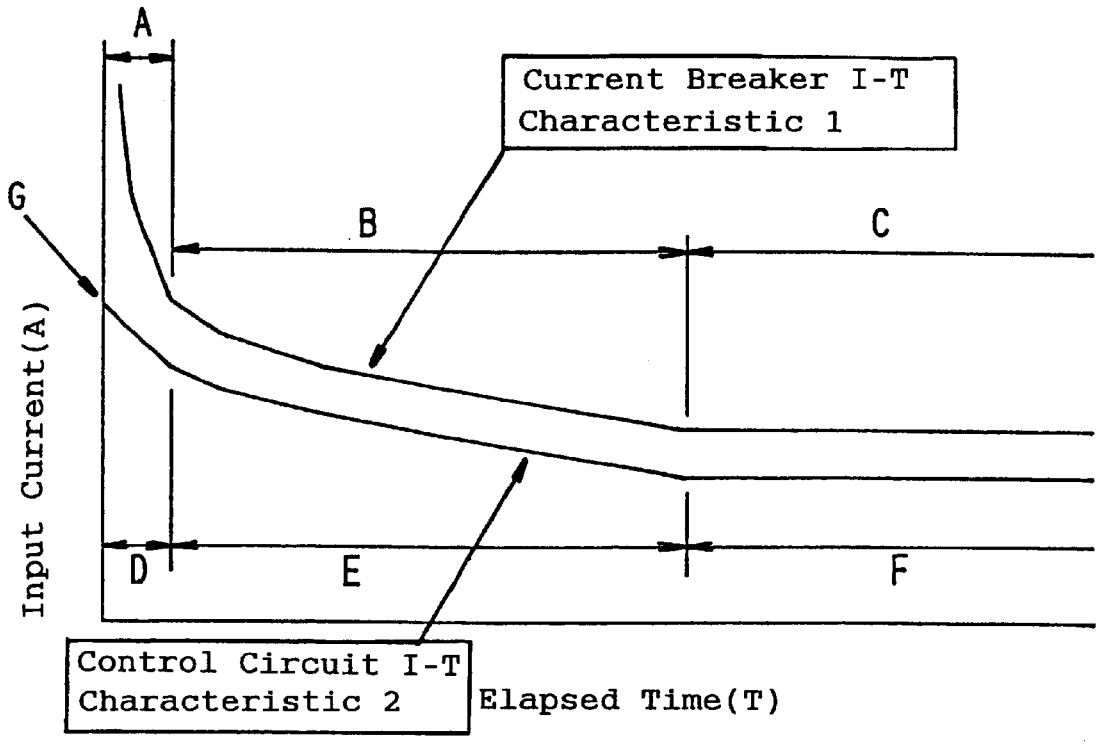
FIG. 5 is a chart showing the cutoff current decreasing characteristic of a current breaker and the characteristic of input current control in the present invention.
Figure 7:
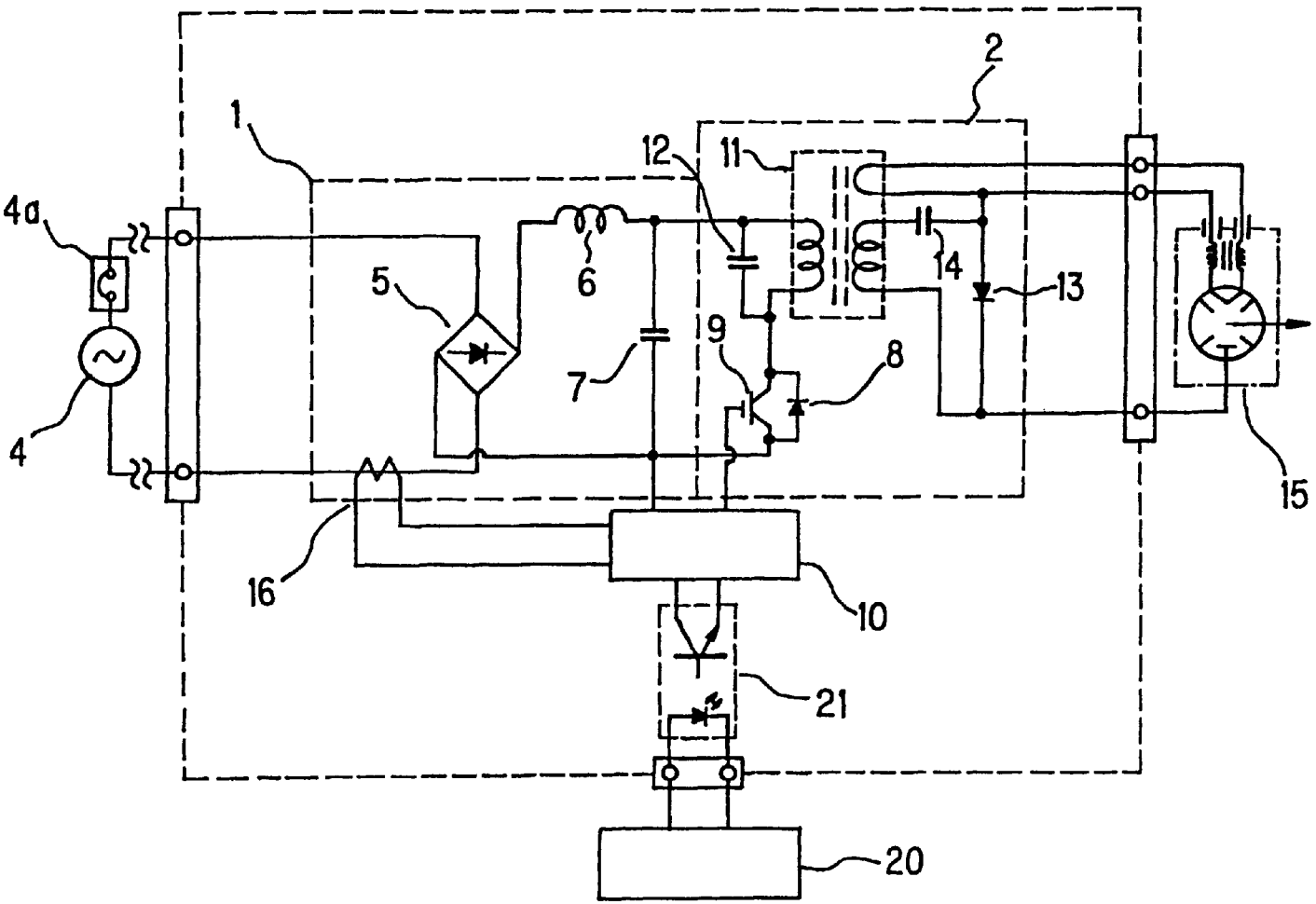
Fig. 7 CONVENTIONAL ART
FIG. 7 is a circuit diagram showing a conventional high-frequency heating apparatus.
Figure 8A:
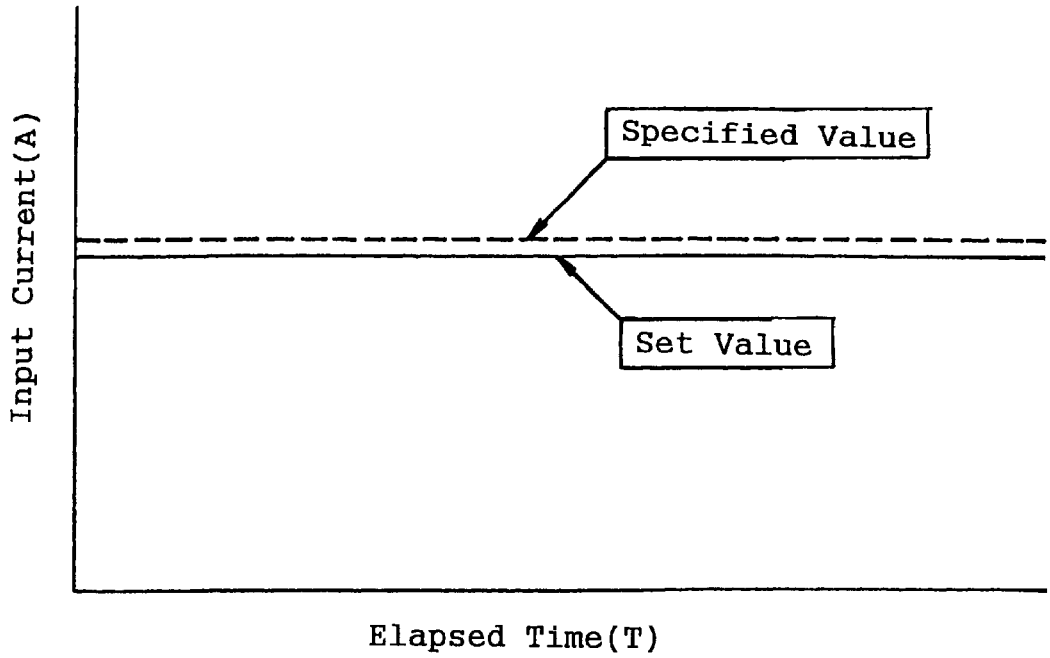
Fig. 8(a) CONVENTIONAL ART
FIG. 8(*a*) is a diagram showing an example of a conventional input current system and FIG. 8(*b*) is a diagram showing another example of a conventional input current system.
Figure 8B:
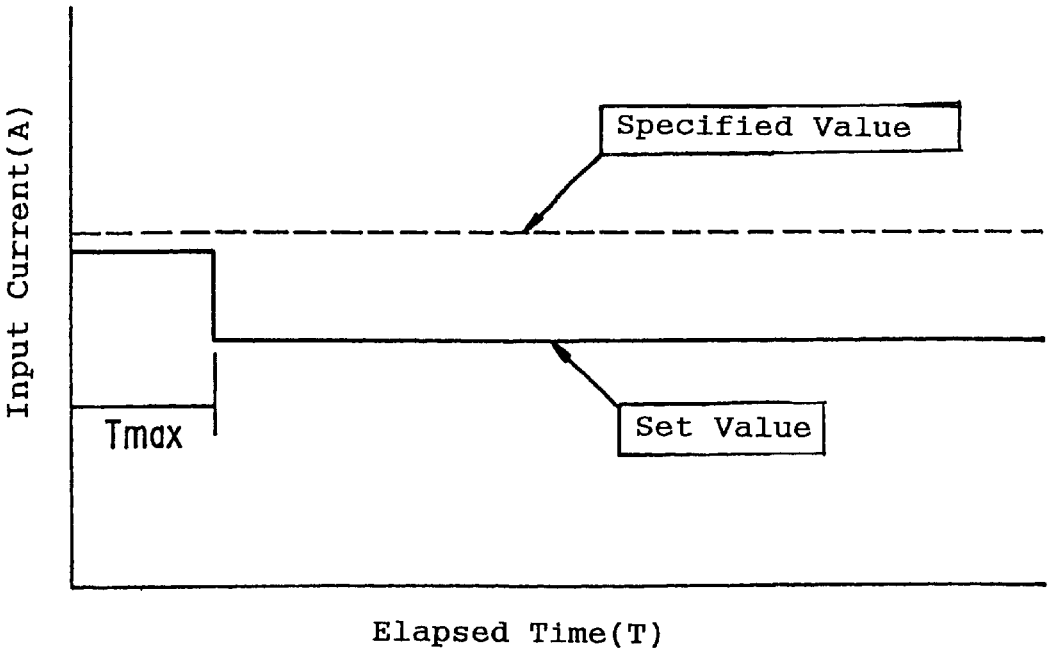
Fig. 8(b) CONVENTIONAL ART
Figure 9:
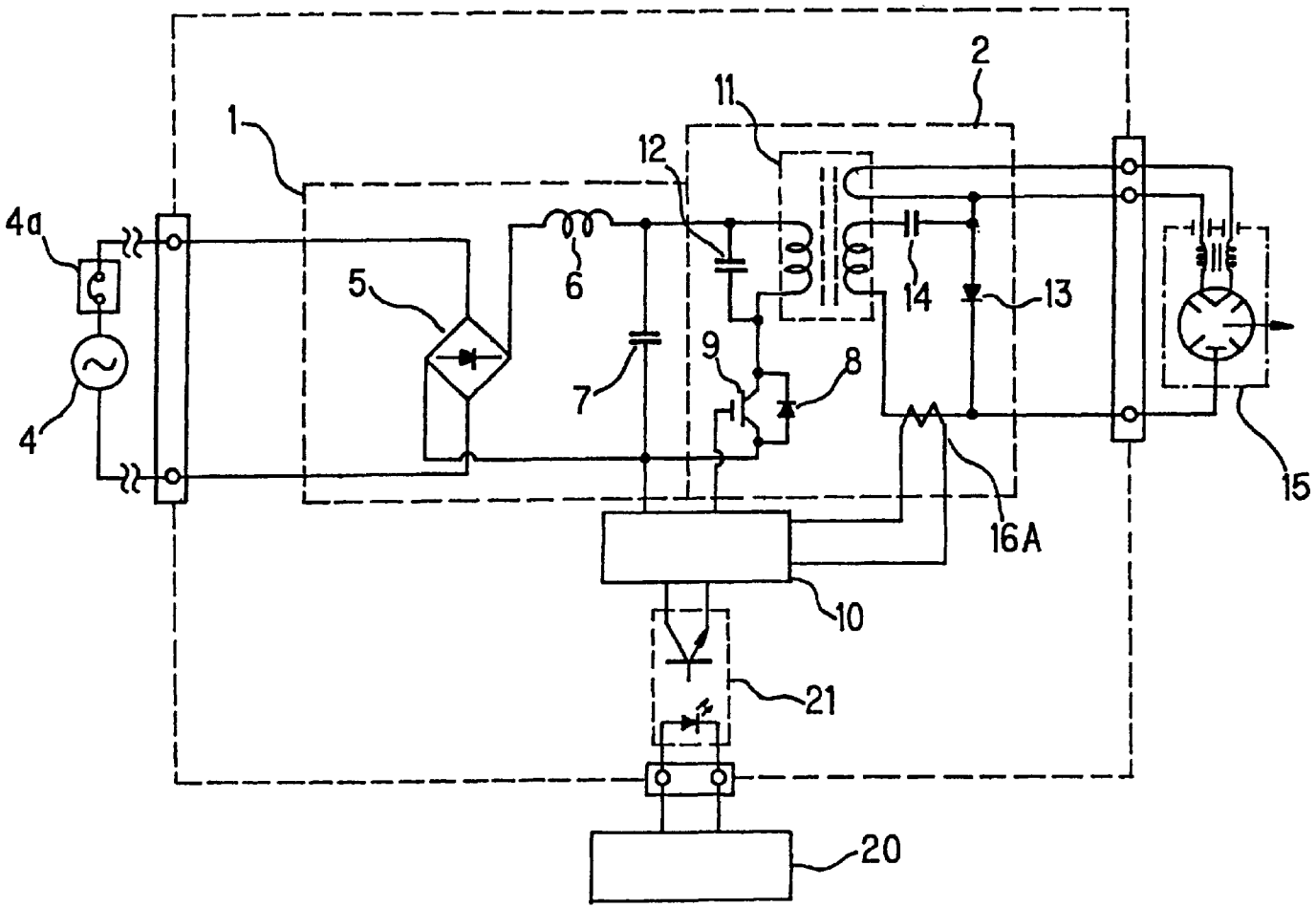
Fig. 9 CONVENTIONAL ART
FIG. 9 is a circuit diagram of a high-frequency heating apparatus based on the conventional current control on the secondary side.
Figure 10:
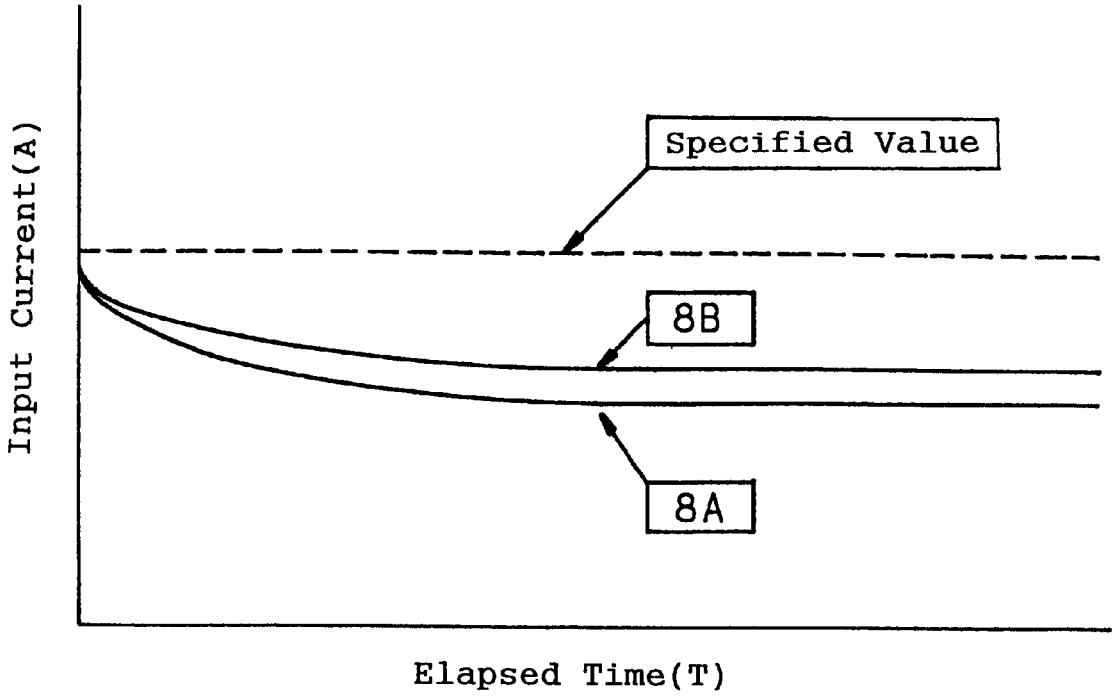
Fig. 10 CONVENTIONAL ART
FIG. 10 is an input current characteristic chart when current control is performed on the secondary side.

FIGS. 1 and 2 shows a high-frequency heating apparatus according to the embodiment. In FIG. 1, the same components as in the high-frequency heating apparatus shown in FIG. 7 as an example of a magnetron drive circuit are allotted with the same reference numerals. FIGS. 3 and 4 are diagrams for explaining an input current comparison scheme; FIG. 4 is a waveform chart relating to an input current detector 16; and FIG. 5 is a waveform chart relating to a control circuit 20.

As shown in FIG. 1, the high-frequency heating apparatus of the embodiment comprises: a power supply unit 1 connected to a commercial power supply 4 with an overcurrent circuit breaker 4*a* arranged on the upstream side supplied with a.c. power of a commercial frequency from the power supply 4, and converting this a.c. power to a d.c. power through a rectifier 5; an input current detector 16; a power converting unit 2 having at least one semiconductor device 9 and a diode 8 to convert the power from the power supply unit 1 into high-frequency waves; an inverter controller 10 for controlling the semiconductor device 9; a magnetron 15 for radiating electromagnetic waves using the power from the power converting unit 2; and a circuit for implementing negative feedback control, in the inverter control circuit 10, of the output from the input current detector 16. The high-frequency heating apparatus further includes a control circuit 20 having a microcomputer for outputting signals to the inverter controller so as to control the input current such that the input current characteristic of the high-frequency heating apparatus will approximate the elapsed time dependent current cutoff characteristic of the overcurrent circuit breaker 4*a*.

Next, detailed description will be made. To begin with, a waveform 1 shown in FIG. 3, which is the analogous output waveform of the input current waveform of the high-frequency heating apparatus is input to inverter controller 10, from input current detector 16. Here, the waveform 1 in FIG. 3 has periods Tn during which no current flows. Since the operational voltage of the magnetron is about 4 kv, the power supply voltage in its low potential periods cannot be boosted up to the operational voltage of the magnetron by step-up transformer 11, this will cause periods with no current flowing to occur, appearing as the periods Tn.

This waveform 1 in FIG. 3 is rectified from the a.c. waveform to the d.c. waveform through a rectifying portion 23, resulting in a waveform 2 shown in FIG. 3. A resistor 22 in FIG. 1 is to adjust the voltage output from input current detector 16. The waveform 2 in FIG. 3 is converted into a d.c. A voltage waveform with a reduced amount of ripple, i.e., waveform 3, by integration of a resistor 24 and capacitor 25.

Next, control circuit 20 generates an output signal having waveform 4 as a PWM signal, which takes High(H) and Low(L) values, as shown in FIG. 4. This waveform is adjusted to an appropriate diode current by means of a current adjustment resistor 26 for the diode of a photocoupler 21. The phototransistor of photocoupler 21 outputs from its emitter an output voltage having a waveform 5 shown in FIG. 4 via a resistor 27.

This waveform 5 is integrated by a resistor 28 and capacitor 29 so that the rectangular wave having the waveform 5 in FIG. 4 is converted into a d.c. voltage having a waveform 6, which is supplied to controller 10. Controller 10 compares this waveform 6 with the waveform 3 in FIG. 3 which is the rectified waveform from input current detector 16, whereby the output current for the high-frequency heating apparatus is determined.

In this embodiment, when the Low-period in the waveform 4 in FIG. 4 output from controller 20 is made shorter, the d.c. voltage of the smoothed, integrated waveform becomes higher. This, as a result of comparison, will set the output voltage from input current detector 16 higher, in other words, the input current can be increased. On the contrary, when the Low-period is made longer, this will set the output voltage from input current detector 16 lower, or the input current can be reduced.

Thus the input current can be controlled in various manners by means of control circuit 20, using the drive circuit (power converting unit 2) for magnetron 15. Use of this controllability in various ways is one feature of the present invention. Further, the present invention also pays attention to the cutoff characteristic of the home-use overcurrent circuit breaker, for example, which regulates the power supply line to the high-frequency heating apparatus, (or also, the cutoff characteristic of other overcurrent circuit breakers such as overcurrent circuit breakers for regulating the power line to which shop-use high-frequency heating apparatus or factory-use high-frequency heating apparatus is connected).

First, the characteristic 1 shown in FIG. 5 represents the cutoff current characteristic over the elapsed time (to be referred to hereinbelow as I-T characteristic) of a typical overcurrent circuit breaker (to be mentioned hereinbelow as a breaker) for home use.

This I-T characteristic can be sectioned with respect to the elapsed time into periods A, B and C. First, the period A represents the fast-cutoff characteristic of the breaker and corresponds to the elapsed time of about 10 to 20 seconds from the start of heat. It is understood that the breaker will not cutoff easily, in this period.

Next, in the period B the cutoff current gradually declines, and this period corresponds to the elapsed time of about 10 to 30 minutes.

Finally, in the period C, the cutoff current of the breaker is stabilized.

When the input current to the high-frequency heating apparatus is controlled so that the output signal from control circuit 20 will have the characteristic 2 shown in FIG. 5, first the input current is controlled, following the I-T characteristic, so as to gradually decline in the period D corresponding to the period A. Then in the period E corresponding to the period B, the current is controlled so as to decline in a gentler manner than that in the period D. Then, in the period F corresponding to the period C the input current is controlled so as to be constant. In this way, the input current represented by the characteristic 2 in FIG. 5 is allowed to have a constant margin relative to the current cutoff characteristic of the breaker represented by the characteristic 1. Thus, it is possible to avoid the breaker quickly cutoff.

In the characteristic 2, the input current, after the start of heating at the point G, through the high-frequency heating apparatus can be set to be maximized within the range not exceeding the maximum breaker current. This feature makes it possible for the high-frequency heating apparatus to utilize the maximum power of the high-frequency output, in the high-frequency heating apparatus.

When the I-T characteristic of the breaker is regarded on the whole, the input current decreases as the time elapses. That is, the high-frequency heating apparatus can operated so that magnetron 15 will be supplied with the maximum power by supplying the maximum input current immediately after the start of heating. Thereafter, to gradually decrease the input current is also effective in suppressing increase in temperature saturation due to a continuous operation.

The high-frequency heating apparatus has a commercial power supply step-up transformer used in the drive circuit for magnetron 15. Input current controller 10 and control circuit (input current controller) 20 can be operated so that the input current will approximate the decreasing current characteristic with respect to the elapsed time of heating and the increasing current characteristic with respect to the elapsed time of the inactive time. The control of this operation will be described next with reference to FIGS. 6(*a*) and 6(*b*).

Figure 6:
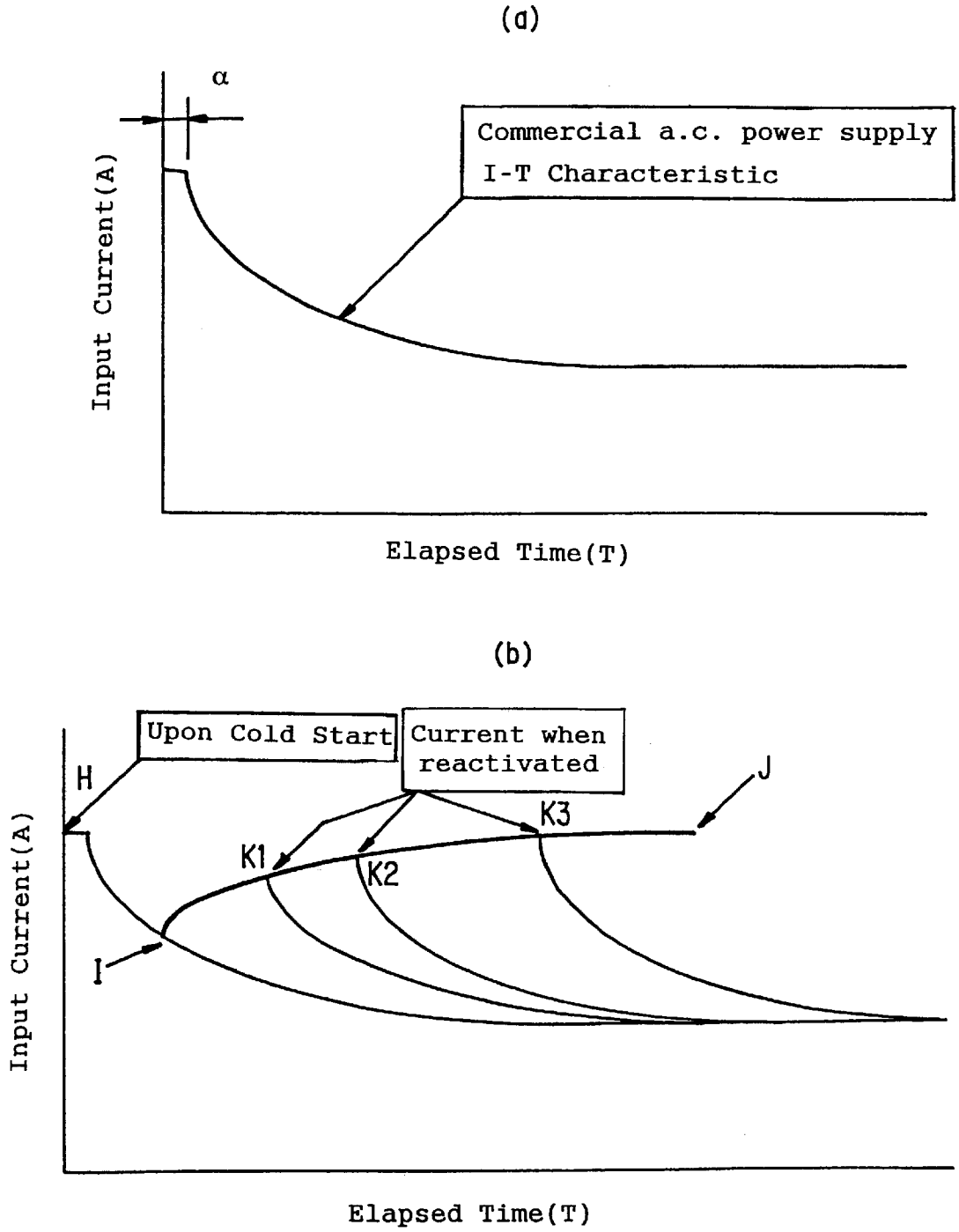
FIG. 6(*a*) is an I-T characteristic chart of a commercial a.c. power supply transformer system and FIG. 6(*b*) is a chart showing the scheme of input current control in a case where a commercial power supply transformer is applied to a magnetron drive circuit.

Before explanation, as regards the relationship between the input current and the operational voltage of the magnetron in the commercial a.c. power supply transformer system, as the operational voltage of the magnetron decreases, so does the input current. In other words, when the magnetron is elevated in temperature as the heating operation starts to output high-frequency waves, the input current will decrease. In the actual operation, the capacity of the magnetron is so large that the temperature will not rise at once. Therefore, there is a period ($\alpha$) during which the input current will not decrease yet. FIG. 6(*a*) shows the current decreasing characteristic including this effect.

Use of the characteristic shown in FIG. 6(*a*), taking into account the variation due to inactive time of the high-frequency heating apparatus also features the present invention, and will be described with reference to FIG. 4(*b*).

First, suppose that when the magnetron of the high-frequency heating apparatus is activated under room temperature, it starts heating at a point H and heating is ended at a point I. Up to this point, the operation follows the current decreasing characteristic shown in FIG. 6(*a*). If the high-frequency heating apparatus is left inactive from the point I, the magnetron gradually decreases in temperature by self-cooling, hence the input current at a point of reactivation will increase as the elapsed time becomes longer from the point I to a point J.

Now, when the apparatus is reactivated from a point K1, the input current varies from a current value higher than that at the point I, gradually decreasing. When the apparatus is left inactive in a longer time and is reactivated from point K2 or K3, the input current will start from a level further higher. The apparatus is left inactive for a further longer time, the magnetron is completely cooled down, the initial input current will start from the current level at the point H.

In the embodiment, the input current control shown in FIG. 5, FIG. 6(*a*) or FIG. 6(*b*) can be simulated by the microcomputer in control circuit 20, so that the apparatus can closely follow the characteristic.

Next, with reference to FIG. 2, the embodiment of the high-frequency heating apparatus being totally controlled based on the input current will be described. Illustratively, the high-frequency heating apparatus incorporates electric devices that support normal performance, such as a turntable motor 32, fan motor 33, and the like while input current detector 16 is to detect the input current including the accompanying electric appliances. Input current detector 16 controls the whole high-frequency heating apparatus based on the detected current.

Here, as shown in FIG. 2, the high-frequency heating apparatus is provided as a product having an oven lamp 31 for allowing clear view inside the box, turntable motor 32 for turning articles to be heated in order to uniformly heat the articles, fan motor 33 for cooling the heated apparatus, and other components. In this embodiment, input current detector 16 is arranged on the power supply line from commercial power supply 4 to high-frequency heating drive circuit 30. That is, the detector is inserted at such a position that enables detection of the currents through the parts that support the normal performance of the high-frequency heating apparatus, such as oven lamp 31, turntable motor 32, fan motor 32 of the high-frequency heating apparatus, so as to monitor the input current of the whole machine.

As has been described heretofore, according to the present invention, the following effects can be obtained.

(1) It is possible to secure a constant current margin relative to the breaker, hence realize stable power supply, by implementing current control such as to approximate the breaker characteristic installed for domestic use.

(2) By approximating the input current control that is based on the commercial a.c. power supply system, it is possible to simply transfer the auto-menu operations of one high-frequency heating apparatus to another. This enables efficient development and designing.

(3) Since the high-frequency output is maximized at the initial stage of operation by taking into account the decreasing characteristic of the input current, foods to be cooked can be heated by causing the high-frequency heating apparatus to operate at the maximum efficiency. Further, since the current declines with the lapse of time, the temperature of the parts can be reduced.

(4) Control of the primary side input current makes it possible to secure an appropriate margin relative to the current breaker and relative to the temperature specification, even if the power supply voltage fluctuates. Hence this configuration provides ease of designing.

(5) Current control with a higher precision can be realized by controlling the input current of the whole machine.

(6) By approximating the current control that is based on the temperature of the magnetron, the input current upon reactivation is reduced so as to improve the reliability with respect to the temperature of the high-frequency heating apparatus.

INDUSTRIAL APPLICABILITY

As has been described, the high-frequency heating apparatus according to the present invention is effective in being applied to an microwave oven which is connected to a power line including an overcurrent circuit breaker (breaker) and supplied with alternating electric power. The present invention is suitable to being applied to a heating cooker which is able to output the maximum high-frequency waves while keeping the overcurrent circuit breaker from cutting off so quickly.

What is claimed is:

1. A high-frequency heating apparatus comprising:

a power supply unit, connected to a power supply line with an overcurrent circuit breaker arranged on the upstream side, supplied with a.c. power from the power supply line, and converting the a.c. power to a d.c. power;

an input current detector;

a power converting unit having at least one semiconductor device to convert the power from the power supply unit into high-frequency waves;

a device controller for controlling the semiconductor device;

an electromagnetic wave radiating unit for radiating electromagnetic waves using the power from the power converting unit; and a circuit for implementing negative feedback control, in the device controller, of the output from the input current detector, The high-frequency heating apparatus further including an input current controller for controlling the input current such that the input current characteristic of the high-frequency heating apparatus will approximate the current cutoff characteristic of the overcurrent circuit breaker with respect to the elapsed time.

2. The high-frequency heating apparatus according to claim 1, wherein the high-frequency heating apparatus uses a commercial a.c. power supply high-voltage transformer in a magnetron drive circuit, and the input current controller controls the input current so that it will approximate the decreasing current characteristic with the passage of the heating time of the magnetron drive circuit and the increasing current characteristic with the passage of the inactive time.

3. The high-frequency heating apparatus according to claim 2, wherein control of the input current is implemented taking into account the cases of reactivation.

4. The high-frequency heating apparatus according to claim 1, wherein the frequency heating apparatus incorporates electric devices such as a turntable motor, motor fan and the like that support the normal performance thereof, and the input current detector is to detect the input current including that for the accompanying electric devices and the input current detector controls the whole high-frequency heating apparatus based on the detected current.

* * * * *